US006905121B1

(12) United States Patent
Timpano

(10) Patent No.: US 6,905,121 B1
(45) Date of Patent: Jun. 14, 2005

(54) APPARATUS AND METHOD FOR SELECTIVELY PERMITTING AND RESTRICTING PLAY IN A CARD GAME

(76) Inventor: Mike Timpano, 364 Grenville Ave., Orillia, Ontario (CA) L3V 7P7

( * ) Notice: Subject to any disclaimer, the term of this patent is extended or adjusted under 35 U.S.C. 154(b) by 0 days.

(21) Appl. No.: 10/775,298

(22) Filed: Feb. 9, 2004

Related U.S. Application Data

(60) Provisional application No. 60/446,378, filed on Feb. 10, 2003.

(51) Int. Cl.[7] ..... A63F 1/00
(52) U.S. Cl. ..... 273/292; 273/274; 273/309; 463/20
(58) Field of Search ..... 273/292, 274, 273/309; 463/20

(56) References Cited

U.S. PATENT DOCUMENTS

| | | | | |
|---|---|---|---|---|
| 3,764,146 | A * | 10/1973 | Vogel | 273/295 |
| 3,841,637 | A * | 10/1974 | Piazza et al. | 273/141 A |
| 4,281,835 | A * | 8/1981 | Seiden | 273/299 |
| 4,314,700 | A * | 2/1982 | Dylag | 273/148 R |
| 4,362,303 | A * | 12/1982 | Pell | 273/274 |
| 4,586,712 | A * | 5/1986 | Lorber et al. | 273/149 R |
| 5,029,797 | A * | 7/1991 | Levorchick et al. | 248/459 |
| 5,221,091 | A * | 6/1993 | Gallegos et al. | 273/247 |
| 5,383,666 | A * | 1/1995 | Kaplan | 273/148 R |
| 5,692,750 | A * | 12/1997 | Poole | 273/161 |
| 5,836,586 | A * | 11/1998 | Marks et al. | 273/292 |
| 5,887,873 | A * | 3/1999 | Freeman | 273/303 |
| 5,927,719 | A * | 7/1999 | Young | 273/302 |
| 6,113,102 | A * | 9/2000 | Marks et al. | 273/292 |
| 6,193,235 | B1 * | 2/2001 | Vancura et al. | 273/292 |
| 6,446,973 | B1 * | 9/2002 | Pham | 273/306 |
| 2003/0060267 | A1 * | 3/2003 | Glavich et al. | 463/20 |
| 2003/0064798 | A1 * | 4/2003 | Grauzer et al. | 463/29 |
| 2003/0157977 | A1 * | 8/2003 | Thomas et al. | 463/13 |
| 2003/0186739 | A1 * | 10/2003 | Paulsen et al. | 463/25 |
| 2003/0193140 | A1 * | 10/2003 | Hoyt et al. | 273/292 |
| 2004/0056421 | A1 * | 3/2004 | Chlu et al. | 273/292 |
| 2004/0090004 | A1 * | 5/2004 | Dreaper et al. | 273/292 |

OTHER PUBLICATIONS www.google.com-embossed playing cards pp. 1-2.*
www.bridgemagazine.co.uk/shop pp. 1-3.*
www.printapresent.com.*

* cited by examiner

*Primary Examiner*—Gregory Vidovich
*Assistant Examiner*—Dolores Collins
(74) *Attorney, Agent, or Firm*—Robert Ryan Morishita; Anderson & Morishita

(57) ABSTRACT

Play of a game is controlled using an indicator card. The indicator card is optionally the size and shape of a playing card and may include indicia thereon. The indicator card is inserted into a randomized stack of playing cards. From the top of the stack to the indicator card, play is conducted in conventional fashion while permitting additional players to join. When the indicator card is reached, the indicator card is optionally displayed and play is conducted in conventional fashion without permitting additional players to join.

20 Claims, 3 Drawing Sheets

APPARATUS AND METHOD FOR SELECTIVELY PERMITTING AND RESTRICTING PLAY IN A CARD GAME

RELATED APPLICATION DATA

The present application claims the priority of U.S. Provisional Application Ser. No. 60/446,378, entitled "Apparatus and Method for Selectively Permitting and Restricting Play in a Card Game," filed Feb. 10, 2003 by Applicant herein.

FIELD OF THE INVENTION

The present invention relates to card games, optionally card games that utilize multiple decks of playing cards. More specifically, the present invention is a method and device for selectively permitting play of a card game in situations where the risk of card counting is relatively low and restricting play of a card game in situations where the risk of card counting is relatively high.

BACKGROUND OF THE INVENTION

Blackjack is a common casino card game. The object of Blackjack for the player is to have a final hand total closer to twenty-one than the dealer's final hand total without exceeding twenty-one. For purposes of calculating the final hand total, each card has a value equal to its face value except face cards, which have a value of ten, and aces, which may have a value of eleven or one.

Each player makes a base wager. The dealer deals two cards to each player and two cards, one card face up and the other face down, to himself or herself. Any player receiving a natural twenty-one or Blackjack, i.e. a total of twenty-one in the initial dealt hand, is immediately rewarded, typically at a rate of 2:1 or 3:2, and play is terminated as to that player.

Each remaining player examines the player's hand and decides whether to hit, i.e. receive another card, or stand, i.e. stand on the player's current hand. A player may hit as many times as the player wishes as long as the player does not bust, i.e. receive a card causing his cumulative total to exceed twenty-one. When a player busts, the player's wager is immediately collected and play is terminated as to that player.

A player may also have additional options available depending on the initial player hand dealt. If the player receives a pair, i.e. two cards having the same face value, the player may split the pair and use each card as a basis for a separate hand. A player may also have the option to double down. Although the availability of the double down option vary from casino to casino, the option allows a player to double the player's wager in exchange for a single additional card.

After all the players have played their hands, the dealer reveals the face-down card in the dealer's hand. The dealer plays the dealer's hand according to established house rules. That is, the casino uses established rules to eliminate the dealer's discretion hits or stands as the house rules dictate, and resolves the wagers. In resolving the wagers, players with a final hand total closer to twenty-one than the dealer's final hand total are rewarded at 1:1. Conversely, wagers are collected from players with a final hand total further from twenty-one than the dealer's final hand total. If the dealer busts, all players who did not bust or receive a Blackjack are rewarded. If the player and dealer push, i.e. have the same final hand total, the player's wager is returned.

Players have a great deal of discretion in decision making in Blackjack. As a consequence, it is known that players can improve the odds of winning in Blackjack by basing their decisions on the cards known to remain undealt during play of a hand. One process of tracking undealt cards is known as card counting.

Card counting originated as actually tracking which cards, or at least the number of ten and eleven value cards, had been dealt. That is, in a single deck, there are thirty-two non-ten value cards, sixteen ten value cards, and four Aces. Theoretically, a player could track which cards had been dealt and, by deduction, discern the cards remaining undealt. By basing his or her decisions on the undealt cards, a player could improve his or her chances to predict the outcome of the game.

Casinos reacted to the success of players using card counting methods by using multiple decks of playing cards dispensed from card shoes. By increasing the number of decks, casinos not only make it more difficult to "count cards" but also increase the combinations possible in any dealt game. In fact, it is known that by using a four deck shoe, a casino increases its house advantage by 0.54%. The response by card counters has been to employ a different card counting method that tracks the trend of the undealt cards rather than directly tracking the cards dealt.

For example, in one multiple deck counting system, tens and Aces are counted as "−1," deuces through sixes are counted as "+1," and sevens through nines are counted as "0." The player maintains a running count and increases or decreases his wagers as the trend of the undealt cards runs positive or negative, respectively. For example, after a game in which the cards 3 5 5 7 10 K K A were dealt, a count of −1 (obtained by 1+1+1+0−1−1−1−1) would be added to the cumulative count. A negative count would indicate that the undealt cards are rich in low cards unfavorable to the player. Conversely, a positive count would indicate that the undealt cards are rich in high cards favorable to the player.

To combat the card counters, elaborate procedures are used to prepare the playing cards before loading the playing cards into a card shoe. The playing cards are randomized, such as by shuffling and cutting. Frequently, the cards are cut by a player inserting a cut indicator card into the shuffled cards. The cards below the cut indicator card are shifted to the top of the stack of shuffled cards. The cut indicator is then inserted into the stack of shuffled cards to indicate where the deck will be reshuffled. When the cut indicator card is reached, the game is completed and the playing cards are reshuffled and re-cut. The purpose of this step is to eliminate from play a number of cards to interfere with usefulness of a card counter's cumulative count. Additionally, a number of cards from the top of the stack may be "burned" by removing them from play. Again, the purpose of burning is to randomly eliminate cards to interfere with the effectiveness of a card counter's cumulative count.

Another rule undertaken to thwart card counters is a rule preventing players from joining a game in mid-shoe. In casinos employing such a rule, a player may only join a game at the beginning of a card shoe. If the dealer has already begun dealing the shoe, new players may not join the game.

The drawback of this rule is that the casino is limited in the number of hands that can be dealt in a given period of time. That is, more hands will be dealt in a unit time if six players are playing than two players. This, of course, directly affects to the profitability of a table. In a broader sense, this rule also affects the profitability of the casino since customers who are waiting for a table to permit players to join are not playing but watching. Since casinos make no money from customers who are not playing, there is a need in the art to minimize the time in which players are precluded from joining a game.

One response is to continuously shuffle cards using an apparatus like that shown in U.S. Pat. No. 4,586,712. That is, rather than using a shoe and a discard pile, discarded cards are continuously shuffled into the undealt cards. The drawback of this system is the expense of the continuous shuffler.

Another response is to this is to prevent players from seeing the cards dealt to other players. Such a system is shown in U.S. Pat. No. 4,314,700 which shows partitions between each player to obscure a player's view of other players' cards. Such a system is aesthetically unappealing. More importantly, partitions could obscure the view of the dealer and the casino operator and thereby create an opportunity for other forms of cheating such as the palming of cards or gaming chips.

SUMMARY OF THE INVENTION

The present invention is an indicator card for selectively restricting and permitting play in a card game and a method of use. Optionally, the indicator card is sized to fit in a card shoe. For example, in an optional embodiment, the indicator card is substantially the size and shape of a playing card. The indicator card optionally includes indicia thereon indicating the purpose of the card. In a further optional embodiment, the indicator card includes indicia thereon to assist a dealer in positioning the indicator card within a stack of playing cards.

The indicator card is used by inserting the indicator card into a stack of randomized playing cards. Optionally, the indicator card is inserted half way between the top of a stack of playing cards and a cut card marking the end of the playable cards.

From the top of the stack of playing cards until the indicator card is reached, additional players are permitted to join the game. Play of the base game is conducted in a conventional manner with dealt cards being moved to a discard pile after use. When the indicator card is reached, no new players are permitted to join the game. Optionally, the indicator card is displayed, such as in a stand on the playing table, once it is reached. Once again, play of the base game is conducted in a conventional manner until the cut card is reached. The undealt cards remaining are randomized with the cards from the discard pile.

DESCRIPTION

Figure 1:
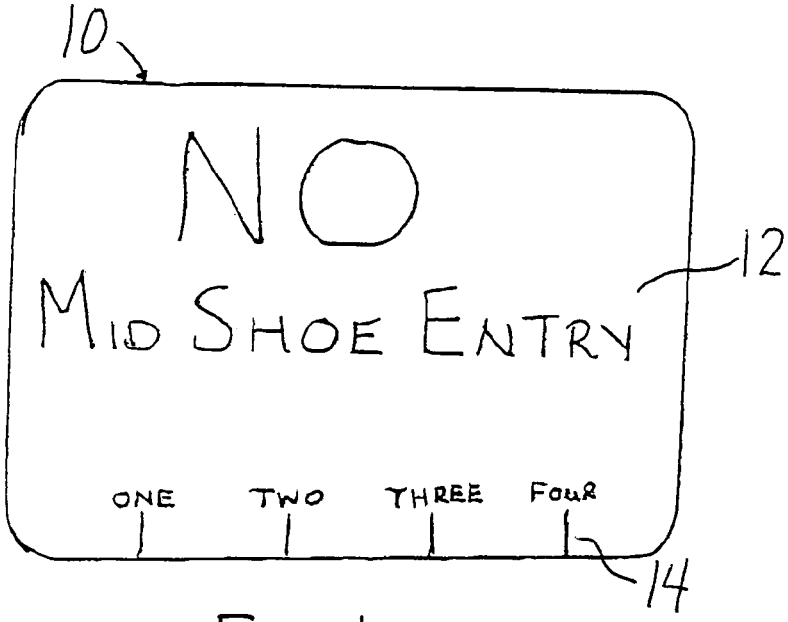
FIG. 1 is a front view of an indicator card according to an embodiment of the present invention.

Reference is now made to the figures wherein like parts are referred to by like numerals throughout. Referring first to FIG. 1, the present invention includes an indicator card 10. The indicator card 10 is optionally formed from a material of greater durability than a conventional playing card 18. For example, the indicator card 10 may be a thin sheet of plastic or the like.

The indicator card 10 is optionally sized and shaped to fit into a card shoe 16. Since most conventional card shoes 16 have walls spaced substantially equal to the length of a playing card 18, this means that at least one dimension of the indicator card 10 is substantially equal to the length of a playing card 18, in such an optional embodiment. In a further optional embodiment, the length and width of the indicator card 10 is substantially equal to the length and width of a playing card 18. That is, in an optional embodiment, the indicator card 10 is substantially the size of a playing card 18.

The indicator card 10 is distinguishable from said playing cards 18. This could be accomplished visually by making the indicator card 10 distinguishable in size, shape, color, thickness, or the like. Alternatively or additionally, the indicator card 10 may be tactilely different such as by having a different thickness, texture, weight, stiffness, or the like.

In one optional embodiment, the indicator card 10 may include indicia on one or both surfaces. In the optional embodiment of FIG. 1, the indicator card 10 includes a designation 12 reading "No Mid-Shoe Entry" indicating the role of the indicator card 10. The indicator card 10 may further include indicia thereon to assist a dealer in placement of the indicator card 10 in a stack 20 of randomized cards in an optional embodiment. For example, in the optional embodiment of FIG. 1, the indicator card 10 includes deck markings 14 indicating the approximate width of one or more decks of cards. Thus, the dealer can use the deck markings 14 to measure the desired quantity of cards between the cut card 22 and the indicator card 10 as discussed in greater detail below.

Figure 2:
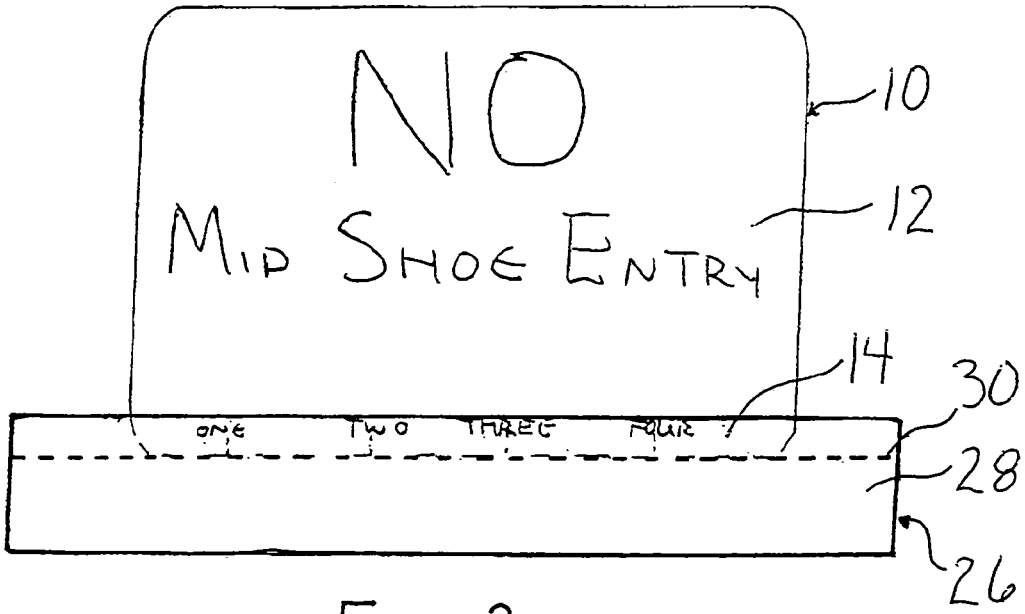
FIG. 2 is a front view of an indicator card and stand according to an embodiment of the present invention.

A stand 26 for the indicator card 10, shown in FIG. 2, may optionally be provided. The use of the stand 26 is described in greater detail below. The stand may be constructed in a variety of ways, such as a pedestal and support, pedestal and clip, or the like. However, the stand 26 of the optional embodiment of FIG. 2 consists of a base 28 with a groove 30 therein such that the indicator card 10 may be inserted into the groove 30 to be held in a substantially vertical fashion.

Figure 3:
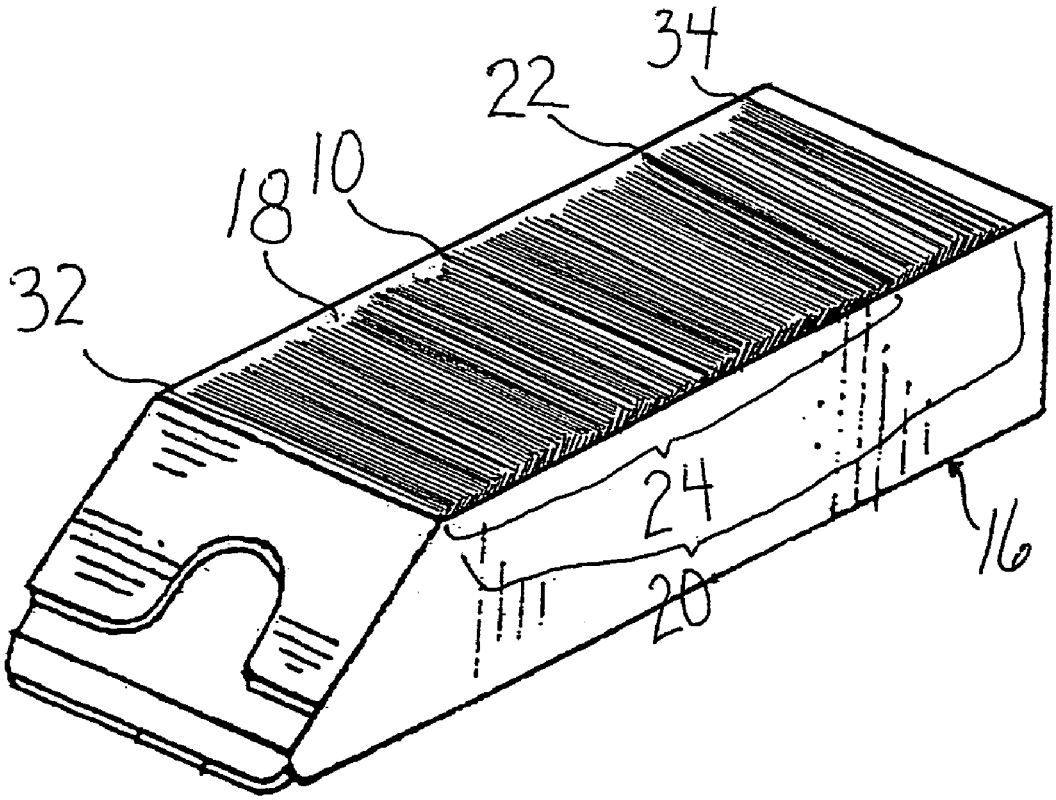
FIG. 3 is an elevated perspective view of a stack of cards in a card shoe with a cut card and indicator card inserted according to an embodiment of the present invention.
Figure 4:
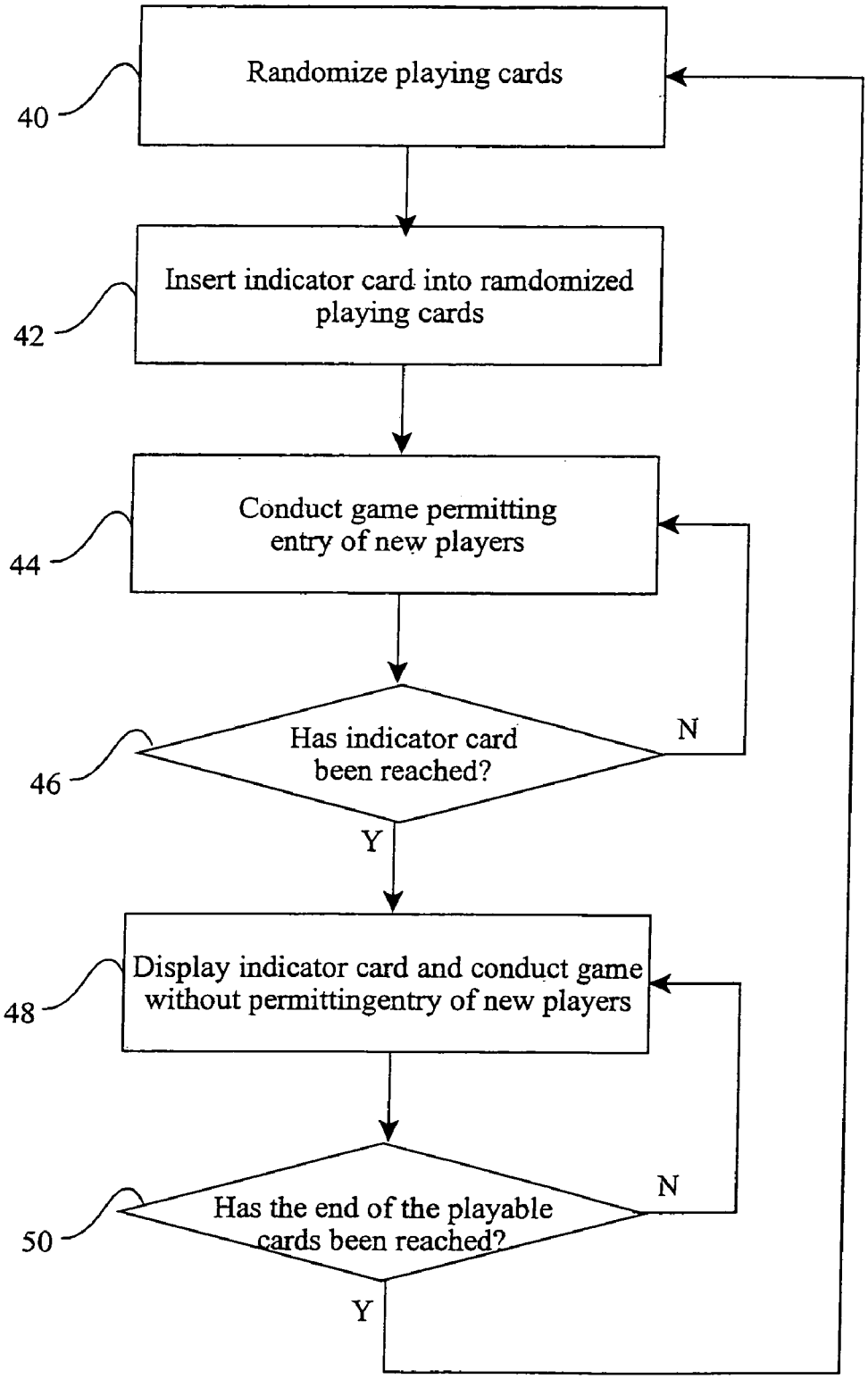
FIG. 4 is a flow chart of a method according to an embodiment of the present invention.

Turning to FIGS. 3 and 4, the indicator card 10 is used in conjunction with playing cards 18 used in a base game. The base game could be any playing card game. The examples below describe the use of the indicator card 10 of the present invention in the game of Blackjack but the indicator card 10 of the present invention could be used in any playing card game. It is also noted that the examples below describe the use of the indicator card 10 in conjunction with a multiple deck card shoe 16. However, it is contemplated that the indicator card 10 could be used with any quantity of cards and any dealing apparatus. Thus, the examples given below should be seen as illustrative of the present invention and not limiting.

Playing cards 18 utilized in the base game are randomized 40. In most instances, this will take the form of shuffling and cutting. It is noted that the shuffling could be automatic or manual. In most games, cutting is performed by a player placing a cut card 22 into a stack 20 of shuffled cards. The cards below the cut card 22 are moved to the top 32 of the stack 20. In an optional embodiment, the stack 20 is moved to a card shoe 16.

The cut card 22, now at the bottom of the stack 20, is optionally moved into the stack 20 to indicate the end of the playable cards 24. In Blackjack, the cut card 22 is typically inserted at least one deck, that is fifty-two cards, into the stack 20 of randomized cards. The purpose of this is to remove a random number of cards from play to frustrate card counters. Another optional step, conventional in the art, for preparing the deck of cards includes "burning," i.e. discarding, one or more cards from the top 32 of the stack 20 of playing cards 18. Burning can take place before or after insertion of the indicator card 10 of the present invention as discussed below.

The indicator card 10 of the present invention is inserted 42 into the stack 20 of cards, now optionally in a card shoe 16. In an optional embodiment including deck markings 14, the indicator card 10 may be used to approximate the desired quantity of cards between the end of the playable cards 24, optionally signaled by the cut card 22, and the indicator card 10.

For example, in an optional embodiment the dealer wishes to place the indicator card 10 approximately half way through the playable cards 24. If the dealer in the example is using a six deck card shoe 16 and has inserted an optional cut card 22 approximately one deck from the bottom 34 of the stack 20, the desired quantity of cards between the cut card 22 and the indicator card 10 is two and one half decks or approximately half the cards between the cut card 22 and the top 32 of the stack 20. Thus, the indicator card 10 may be set along the stack 20 with one deck marking at the cut card 22 thereby allowing the approximate quantity of cards desired to be read from the deck markings 14 on the indicator card 10. In such an example, the indicator card 10 would be placed 42 approximately two and one half decks between the cut card 22 and the top 32 of the stack 20. It is noted that in an alternate optional embodiment, the indicator card 10 may be inserted half way through the stack 20 without regard to the location of the optional cut card 22. In such an alternate optional embodiment, the dealer would place 42 the indicator card 10 approximately three decks from the top 32 of a six deck stack 20.

Play of the base game is conducted 44 in a conventional manner by depleting playing cards 18 from the stack 20. Typically, this consists of dealing playable cards 24 from the top 32 of the stack 20, optionally contained in a card shoe 16. As playable cards 24 have been dealt and played, i.e. after each game, the used cards are moved to a discard pile.

According to the method of the present invention, until the indicator card 10 is reached 46, players may join play between games, space permitting. That is, while dealing playable cards 24 from the top 32 of the stack 20 to the indicator card 10, players are not prohibited from joining play. As the stack 20 is depleted, the indicator card 10 is eventually exposed. Once the indicator card 10 is reached 46, the indicator card 10 signals that additional players will be restricted from joining the game. This could be accomplished by the invocation 48 of a rule prohibiting additional players from joining play.

More specifically, when the dealer deals the indicator card 10, the indicator card 10 is replaced with a playable card 24, since the indicator card 10 has no role or value in the base game. The indicator card 10 is displayed and play is conducted 48 without permitting entry of new players. As discussed above, the indicator card is displayed, optionally on a stand 26 at the playing table, to signal to potential players that they may not join play until the card shoe 16 is completed. The optional designation 12 on the indicator card 10 reading "No Mid-Shoe Entry" assists players in knowing when a rule prohibiting entry into the base game has been invoked 48.

While dealing from the stack 20 of playing cards 18 from the indicator card 10 until the end of the playable cards is reached, optionally signified by the cut card 22, only those players who joined prior to the indicator card 10 are permitted 48 to play the base game. Although the precise effect of the indicator card 10 could vary, it is contemplated that the game in which the indicator card 10 is dealt would be completed and the ensuing games would include the prohibition against new players joining.

When the end of the playable cards 24, optionally marked by a cut card 22, is reached 50, the method of the present invention can be repeated by reconstituting the stack 20 of playing cards 18 by randomizing 40 the cards in the discard pile with the undealt cards remaining in the stack 20 (recalling that undealt cards will remain in the stack 20 below the cut card 22).

While certain embodiments of the present invention have been shown and described it is to be understood that the present invention is subject to many modifications and changes without departing from the spirit and scope of the invention presented herein.

I claim:

1. A device for controlling the play of a card game among players using playing cards comprising:

an indicator card distinguishable from said playing cards, said indicator card inserted into a randomized stack of said playing cards, said indicator card including indicia thereon measuring the approximate depth within said stack at which said indicator card is inserted, said indicator card delineating the point in the conduct of said card game where additional players are permitted to join play of said card game and the point in the conduct of said card game where additional players are restricted from joining play of said card game.

2. The device of claim 1 wherein said indicator card is visually distinguishable from said playing cards.

3. The device of claim 1 wherein said indicator card is tactilely distinguishable from said playing cards.

4. The device of claim 1 wherein at least one dimension of said indicator card is equal to a corresponding dimension of said playing cards.

5. The device of claim 4 wherein all dimensions of said indicator card are equal to the corresponding dimensions of said playing cards.

6. The device of claim 1 further comprising a stand receiving said indicator card.

7. A method of conducting play of a card game among players using playing cards comprising:

providing an indicator card distinguishable from said playing cards;

inserting said indicator card into a randomized stack of said playing cards;

as said stack is depleted through play of said card game, permitting additional players to join play of said card game until said indicator card is reached and restricting additional players from joining play of said card game after said indicator card is reached, wherein play of said card game is conducted according a single fixed set of rules without regard to whether said indicator card is reached.

8. The method of claim 7 wherein said indicator card is visually distinguishable from said playing cards.

9. The method of claim 8 wherein said indicator card includes indicia thereon measuring the approximate depth within said stack at which said indicator card is inserted.

10. The device method of claim 7 wherein said indicator card is tactilely distinguishable from said playing cards.

11. The method of claim 7 wherein at least one dimension of said indicator card is equal to a corresponding dimension of said playing cards.

12. The method of claim 11 wherein all dimensions of said indicator card are equal to the corresponding dimensions of said playing cards.

13. The method of claim 7 further comprising:

providing a stand receiving said indicator card; and when said indicator card is reached, displaying said card to players by placing said indicator card into said stand.

14. A method of conducting play of a card game among players using playing cards according to the conventional rules of Blackjack in which the player makes an initial wager, the dealer deals an initial two-card hand to each of the player and dealer, one of the cards of the dealer's hand dealt face-up, and the player forms a final player hand, the method comprising:

providing an indicator card distinguishable from said playing cards;

randomizing said playing cards and forming said playing cards into a stack;

inserting said indicator card into said stack of playing cards;

conducting said Blackjack game and depleting said stack as playing cards are used;

as said stack is depleted through play of said card game, permitting additional players to join play of said card game before said indicator card is reached and restricting additional players from joining play of said card game after said indicator card is reached, wherein play of said card game is conducted according a single fixed set of Blackjack rules before and after said indicator card is reached.

15. The method of claim 14 wherein said indicator card is visually distinguishable from said playing cards.

16. The method of claim 15 wherein said indicator card includes indicia thereon measuring the approximate depth within said stack at which said indicator card is inserted.

17. The method of claim 14 wherein said indicator card is tactilely distinguishable from said playing cards.

18. The method of claim 14 wherein at least one dimension of said indicator card is equal to a corresponding dimension of said playing cards.

19. The method of claim 18 wherein all dimensions of said indicator card are equal to the corresponding dimensions of said playing cards.

20. The method of claim 14 further comprising:

providing a stand receiving said indicator card; and when said indicator card is reached, displaying said card to players by placing said indicator card into said stand.

* * * * *